US009132675B1

(12) United States Patent
Yu et al.

(10) Patent No.: US 9,132,675 B1
(45) Date of Patent: Sep. 15, 2015

(54) PRESSURE-BALANCED MECHANISM FOR A PRINT HEAD

(71) Applicant: TSC AUTO ID TECHNOLOGY CO., LTD., New Taipei (TW)

(72) Inventors: I-Che Yu, New Taipei (TW); Chao-Cheng Hsu, New Taipei (TW)

(73) Assignee: TSC Auto ID Technology Co., Ltd., New Taipei (TW)

( * ) Notice: Subject to any disclaimer, the term of this patent is extended or adjusted under 35 U.S.C. 154(b) by 0 days.

(21) Appl. No.: 14/503,590

(22) Filed: Oct. 1, 2014

(30) Foreign Application Priority Data

Aug. 20, 2014 (TW) ..... 103214889 U

(51) Int. Cl.
*B41J 2/15* (2006.01)
*B41J 25/312* (2006.01)

(52) U.S. Cl.
CPC ..... *B41J 25/312* (2013.01)

(58) Field of Classification Search
CPC .... B41J 2202/20; B41J 2/155; B41J 2202/19; B41J 2/01
See application file for complete search history.

(56) References Cited

U.S. PATENT DOCUMENTS 6,244,698 B1 * 6/2001 Chino et al. ..... 347/94
6,396,524 B1 * 5/2002 Cooper et al. ..... 347/138
7,136,088 B2 * 11/2006 Yoshida et al. ..... 347/242

* cited by examiner

*Primary Examiner* — Lamson Nguyen
(74) *Attorney, Agent, or Firm* — Rosenberg, Klein & Lee

(57) ABSTRACT

A pressure-balanced mechanism for a print head includes a fixation frame, a pivot point assembly, a print head assembly and a depression assembly. The pivot point assembly further includes a supportive shaft and a pivotal structure. The supportive shaft is connected to the fixation frame. The pivotal structure is to movably sleeve the supportive shaft. The print head assembly further includes a frame structure and a print head module. The frame structure is to sleeve the supportive shaft and has the pivotal structure to contact at an inside thereof. The print head module is mounted inside the frame structure by separating from the pivotal structure. The depression assembly further includes a fix shaft and two depression structures. The fix shaft is connected to the fixation frame. The depression structure slippery along the fix shaft can contact elastically the frame structure outside to the print head module.

4 Claims, 6 Drawing Sheets

PRESSURE-BALANCED MECHANISM FOR A PRINT HEAD

This application claims the benefit of Taiwan Patent Application Serial No. 103214889, filed Aug. 20, 2014, the subject matter of which is incorporated herein by reference.

BACKGROUND OF INVENTION

1. Field of the Invention

The invention relates to a pressure-balanced mechanism for a print head, and more particularly to the pressure-balanced mechanism that can provide a three-point equilibrium forcing pattern having a pivot point and two depression points to improve the printing quality.

2. Description of the Prior Art

In daily life, in order to rapidly and concisely communicate merchandise information, a printing apparatus is usually applied to mass print out the information in a paper form, either to be posted on the merchandises or to be flowed in some other necessary places. For example, the paper-form information can include merchandise tags, bar codes, receipts and any paper the like to record the merchandise information.

In practical application, various retailers and/or various merchandises always have their own tags, bar codes or receipts printed on specific papers. Namely, the sticker papers or the thermal papers as the carrier bodies fed to the printing apparatuses would vary in widths and sizes. Thus, to meet this situation, current printing apparatuses are generally manufactured to fixed specs for matching various-spec carrier bodies.

Nevertheless, though current printing apparatuses may be suitable to carrier bodies with varying widths and sizes, yet it does not mean that the printing apparatuses make changes or adjustments to meet different carrier bodies. Consequently, an obvious and inevitable shortcoming of the current printing apparatuses is that, while in meeting some carrier bodies or after a specific service time, the print head of the printing apparatus would generate non-uniform printing, both in coloring and in lining, due to the unbalanced forcing at the print head. Definitely, any improvement upon this shortcoming for either the current printing apparatus or the print head would be welcome to the art.

SUMMARY OF THE INVENTION

As described in the background section, though the current printing apparatus is generally manufactured to a common specs and is suitable for various carrier bodies with different sizes and thicknesses, yet the shortcoming of non-uniform printing to the conventional printing apparatus does still exist, for the current printing apparatus does not include a pressure-adjusting mechanism to overcome the problem caused by the print head going over the carrier body with variant thicknesses. Namely, the existing problem of unstable quality in printing non-uniform color and lining is still remained to the conventional printing apparatus.

Accordingly, it is the primary object of the present invention to provide a pressure-balanced mechanism for a print head. In the present invention, the pressure-balanced mechanism for a print head includes a fixation frame, a pivot point assembly, a print head assembly and a depression assembly. The pivot point assembly further includes a supportive shaft and a pivotal structure, in which the supportive shaft is connected to the fixation frame and the pivotal structure movably sleeves the supportive shaft. The print head assembly further includes a frame structure and a print head module. The frame structure sleeves the supportive shaft and has the pivotal structure to contact at an inside thereof. The print head module is also mounted inside and onto the frame structure and is spaced from the pivotal structure by a predetermined spacing. The depression assembly further includes a fix shaft and two depression structures. The fix shaft is connected to the fixation frame. Each of the two depression structures sleeves the fix shaft in a slippery manner and is to contact the frame structure at the outside of the print head module. The two depression structures are identical elements arranged symmetrically with respect to the pivotal structure.

In one embodiment of the present invention, the frame structure further includes a module-mounting portion, a supportive shaft portion and two position portions. The module-mounting portion is integrated as a unique piece with the supportive shaft portion. The inside of the supportive shaft portion contacts the pivotal structure. The two position portions are integrated as a unique piece but bifurcated to stand at two opposing sides of the supportive shaft portion. The two position portions are individually to sleeve the respective ends of the supportive shaft. The pivotal structure is located between the two position portions.

In one embodiment of the present invention, the depression structure includes a sliding body, a rotation-interfering member, a twist knob, a spring, a contact head. The sliding body is to sleeve and move slippery along the fix shaft. The rotation-interfering member is rotationally mounted to the sliding body. The twist knob sleeves the sliding body and is buckled with the rotation-interfering member. The spring sleeves a protrusive end of the rotation-interfering member in a free manner and a contact head in a bulking manner. The lower end of the contact head is to contact the outside of the frame structure. Preferably, the depression structure further includes a sleeve tube screwed onto the sliding body and allows the contact head to protrude therefrom.

All these objects are achieved by the pressure-balanced mechanism for a print head described below.

BRIEF DESCRIPTION OF THE DRAWINGS

The present invention will now be specified with reference to its preferred embodiment illustrated in the drawings, in which.

DESCRIPTION OF THE PREFERRED EMBODIMENT

The invention disclosed herein is directed to a pressure-balanced mechanism for a print head. In the following description, numerous details are set forth in order to provide a thorough understanding of the present invention. It will be appreciated by one skilled in the art that variations of these specific details are possible while still achieving the results of the present invention. In other instance, well-known components are not described in detail in order not to unnecessarily obscure the present invention.

Figure 1:
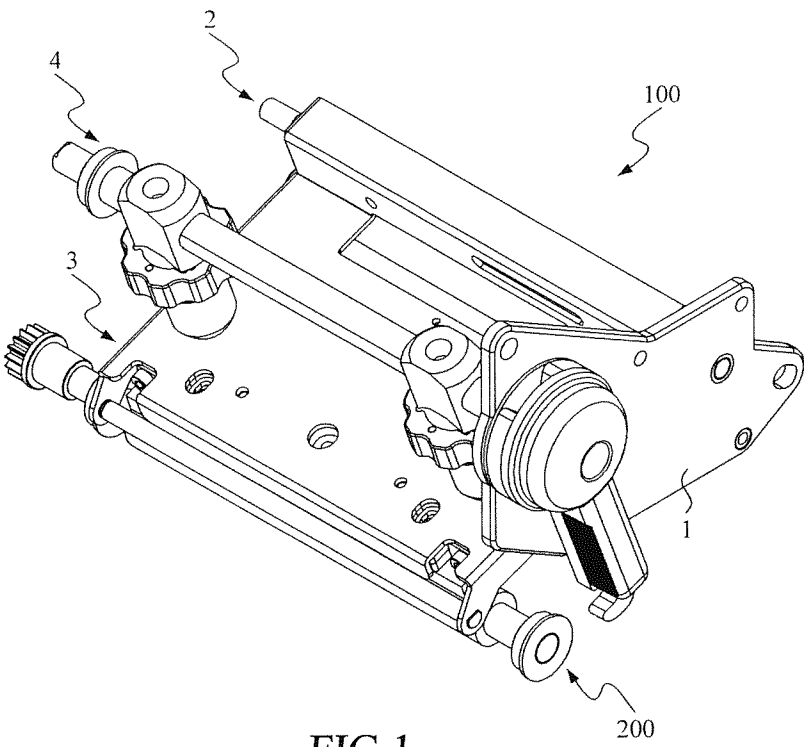
FIG. 1 is a schematic perspective view of the preferred pressure-balanced mechanism for a print head in accordance with the present invention.
Figure 2:
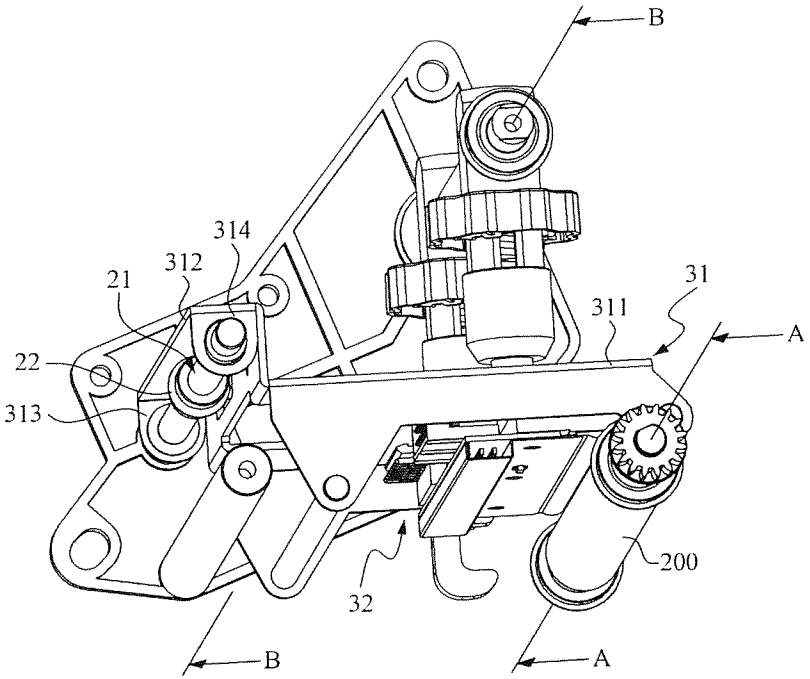
FIG. 2 is another view of FIG. 1.
Figure 3:
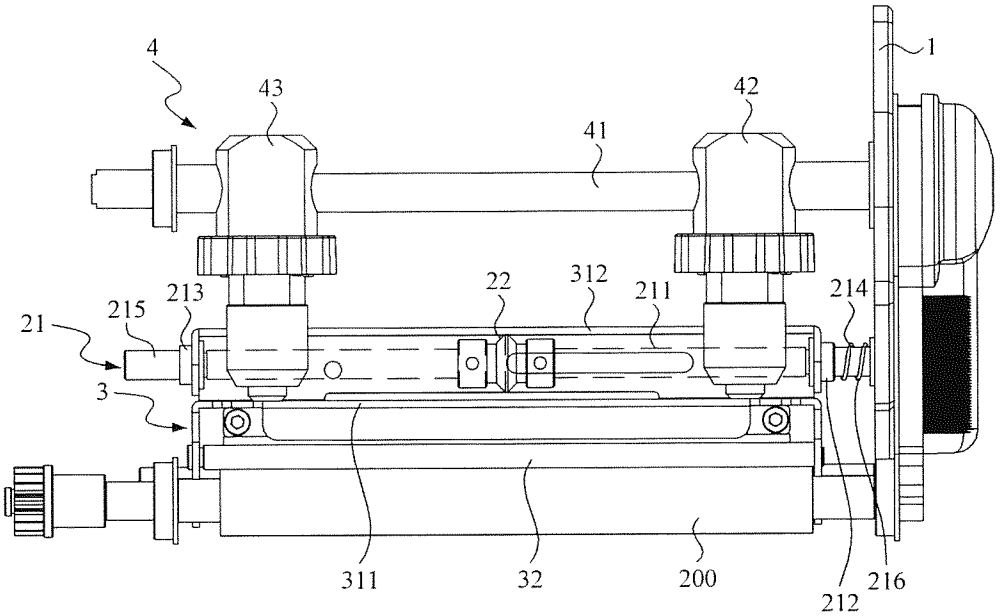
FIG. 3 is a front view of FIG. 1.
Figure 4:
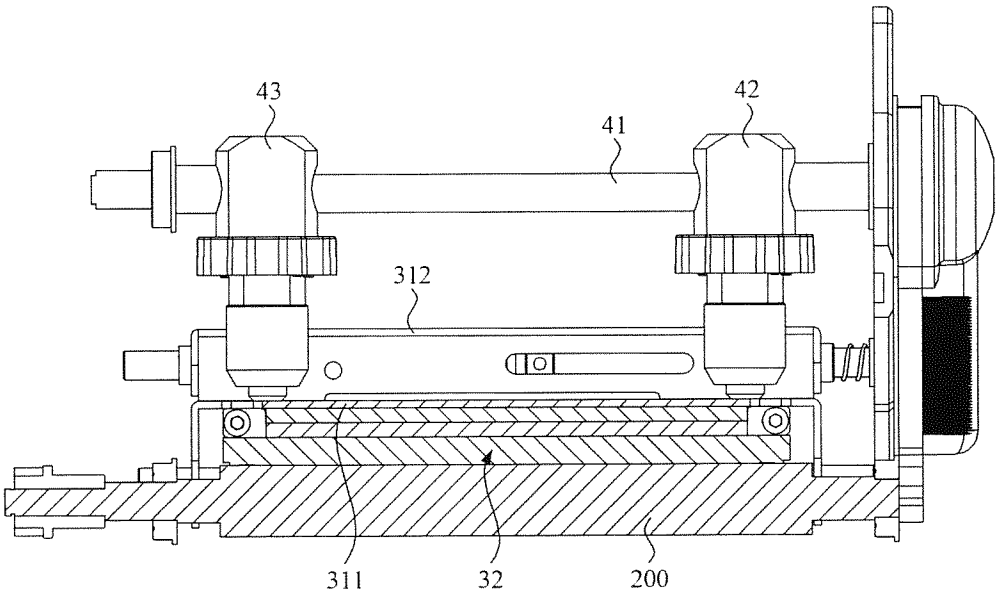
FIG. 4 is a schematic cross-sectional view of FIG. 2 along line A-A.

Refer now to FIG. 1 thru FIG. 4, in which FIG. 1 is a schematic perspective view of the preferred pressure-balanced mechanism for a print head in accordance with the present invention, FIG. 2 is another view of FIG. 1, FIG. 3 is a front view of FIG. 1, and FIG. 4 is a schematic cross-sectional view of FIG. 2 along line A-A.

As shown, the pressure-balanced mechanism for a print head 100 includes a fixation frame 1, a pivot point assembly 2, a print head assembly 3 and a depression assembly 4.

The fixation frame 1 is an extension structure for the pressure-balanced mechanism to be installed to a printing apparatus (not shown in the figures).

The pivot point assembly 2 includes a supportive shaft 21 and a pivotal structure 22. The supportive shaft 21 further includes a main shaft body 211, two shaft collars 212, 213, two coupling shafts 214, 215 and a spring 216. The main shaft body 211 has two opposing ends to be sleeved respectively by the two shaft collars 212, 213. The two coupling shafts 214, 215 are connected to the two respective shaft collars 212, 213, while the coupling shaft 214 is further engaged with the fixation frame 1 so as to allow the supportive shaft 21 to penetrate both the shaft collar 212 and the coupling shaft 214 and further to connect the fixation frame 1. Thus, the whole pivot point assembly 2 can be mounted to the fixation frame 1. In addition, the spring 216 located between the shaft collar 212 and the fixation frame 1 is to sleeve the coupling shaft 214.

The pivotal structure 22 is to movably sleeve the main shaft body 211 of the supportive shaft 21.

The print head assembly 3 includes a frame structure 31 and a print head module 32. The frame structure 31 has a module-mounting portion 311, a supportive shaft portion 312 and two position portions 313, 314.

The module-mounting portion 311 is integrated as a unique piece with the supportive shaft portion 312. The supportive shaft portion 312 has an inside thereof to contact the pivotal structure 22. The two position portions 313, 314 are formed integrally as a unique piece to two opposing sides of the supportive shaft portion 312. In addition, the two position portions 313, 314 are to sleeve at two ends of the supportive shaft 21, while the pivotal structure 22 is extended between the two position portions 313, 314.

The print head module 32 is fixedly mounted inside the module-mounting portion 311 to contact a drum-type roller 200 which is rotationally mounted inside the printing apparatus.

The depression assembly 4 includes a fix shaft 41 and two depression structures 42, 43. The fix shaft 41 is fixedly connected to the fixation frame 1. The depression structures 42, 43 are to individually and movably ride along the fix shaft 41 in a penetration manner and are arranged to the two opposing ends of the pivotal structure 22 for contact at the outside of the module-mounting portion 311 so as to exert pressures upon the module-mounting portion 311, in which the pressures are adjustable to the user.

Figure 5:
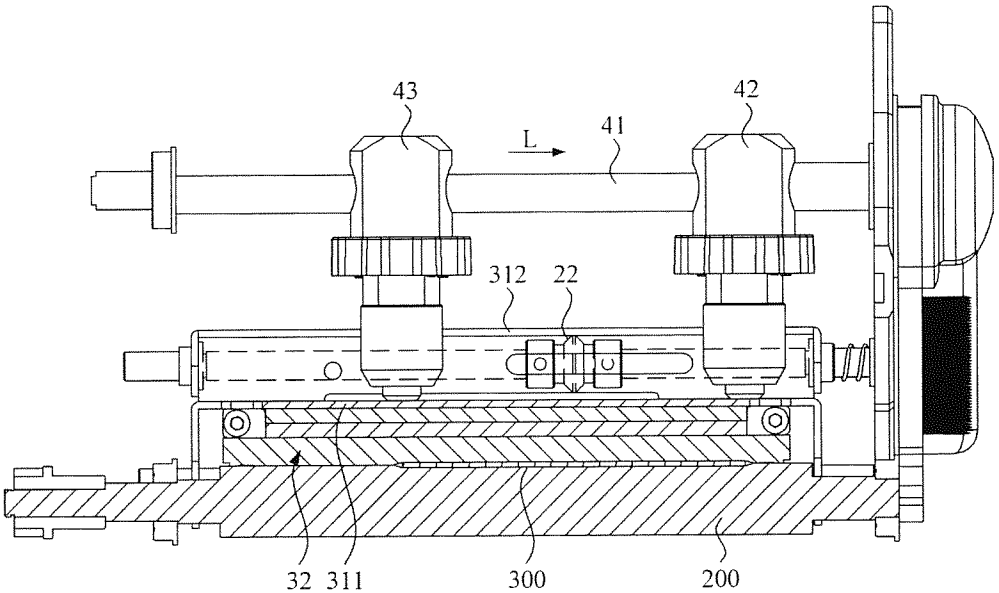
FIG. 5 shows an application state of FIG. 4.

Refer now to FIG. 5, in which an application state of FIG. 4 is shown. As shown, a carrier body 300 is located between the print head module 32 and the drum-type roller 200 in a protrusive manner. Though the width of the carrier body 300 is narrow, yet the user can still displace the pivotal structure 22 in advance along a sliding direction L to a middle portion of the carrier body 300, and then displace further the depression structure 43 along the same sliding direction L to make the distance between the depression structure 43 and the pivotal structure 22 be substantially equal to the distance between the depression structure 42 and the pivotal structure 22. Upon such an arrangement, the pivotal structure 22 would contact the inside of the supportive shaft portion 312 at a place around the middle point of the carrier body 300. Also, the depression structure 42 and the depression structure 43, symmetrically arranged with respect to the pivotal structure 22, would exert symmetrical pressures at the outside of the module-mounting portion 311, such that the print head module 32 can depress upon the carrier body 300 with a distributed pressure and thereby the print head module 32 can print uniform, in both color and lining, letters or figures on the carrier body 300.

Figure 6:
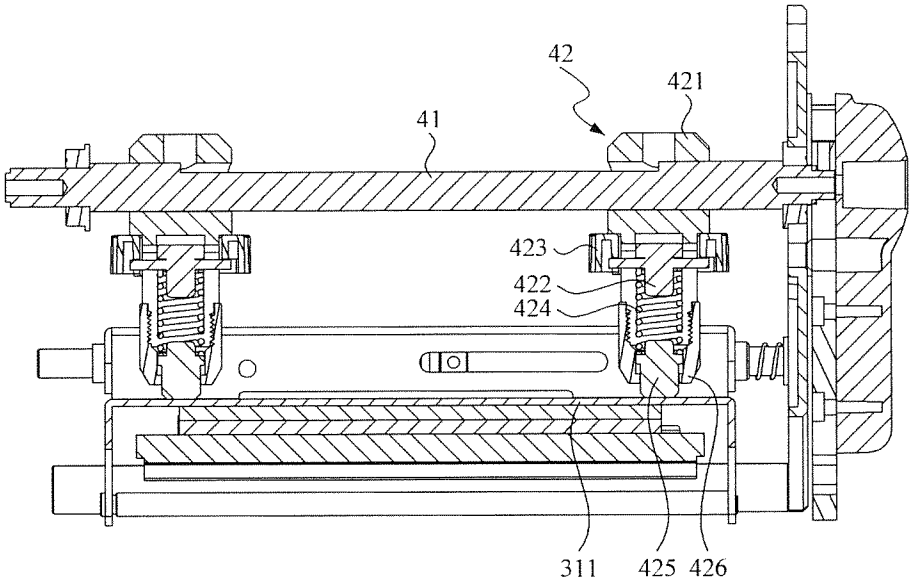
FIG. 6 is a schematic cross-sectional view of FIG. 2 along line B-B.

Referring now to FIG. 6, a schematic cross-sectional view of FIG. 2 along line B-B is shown. In the present invention, the two depression structures 42 and 43 are identical parts arranged to slide along the fix shaft 41 within a middle portion thereof (the portion within the step stops thereof shown in FIG. 6). By detailing the depression structure 42 as an example, the depression structure 42 further includes a sliding body 421, a rotation-interfering member 422, a twist knob 423, a spring 424, a contact head 425 and a sleeve tube 426.

The sliding body 421 is to be slippery penetrated by the fix shaft 41. One end (the top end in the FIG. 6) of the rotation-interfering member 422 is rotationally mounted into an end (the lower end in FIG. 6) of the sliding body 421. The twist knob 423 sleeves the sliding body 421 and engages the rotation-interfering member 422 so as to fix firmly the rotation-interfering member 422 onto the sliding body 421. The spring 424 is to sleeve the rotation-interfering member 422. The contact head 425 is buckled to the spring 424 at one end thereof (the upper end) and has another end (the lower end) to contact the outside of the module-mounting portion 311. The sleeve tube 426 is screwed to engage the sliding body 421 at an lower end thereof and allows the inside contact head 425 to protrude through an lower end of the sleeve tube 426. The engagement tightness between the rotation-interfering member 422 and the spring 424 can be adjusted by turning the twist knob 423 and thereby to adjust the contact pressure between the contact head 425 and the module-mounting portion 311.

By providing the print head of the present invention, the shorting of non-uniform printing to the conventional printing apparatus can be overcome. For the pressure-balanced mechanism for the print head of the invention utilizes a pivotal structure and two depression structures to form a balanced three-point equilibrium state with the frame structure, and also for the pivotal structure and the two depression structures are all movable and thus adjustable while in meeting various widths of the carrier body, so the print head module can exert distributed forcing to depress over the carrier body and thereby uniform printing of the print head module of the present invention onto the carrier body can be achieved.

Further, for the depression structures and the spring of the present invention can be adjusted to provide elastic depression forcing to the rigid module-mounting portion, so the print head module can perform uniform printing upon the carrier body even though the carrier body might not have a unique width.

While the present invention has been particularly shown and described with reference to a preferred embodiment, it will be understood by those skilled in the art that various changes in form and detail may be without departing from the spirit and scope of the present invention.

What is claimed is:

1. A pressure-balanced mechanism for a print head, including:

a fixation frame;

a pivot point assembly, further comprising:

a supportive shaft, connected to the fixation frame; and a pivotal structure, movably sleeving the supportive shaft;

a print head assembly, further comprising:

a frame structure, sleeving the supportive shaft, having the pivotal structure to contact an inside thereof; and a print head module, mounted inside the frame structure by separating from the pivotal structure; and a depression assembly, further comprising:

a fix shaft, connected to the fixation frame; and two depression structures, movably sleeving the fix shaft, contacting elastically the frame structure outside to the print head module;

wherein the two depression structures are arranged symmetrically with respect to the pivotal structure.

2. The pressure-balanced mechanism for a print head of claim 1, wherein the frame structure further includes a module-mounting portion, a supportive shaft portion and two position portions, the module-mounting portion integrating the supportive shaft portion as a unique piece, the supportive shaft portion providing an inside thereof to contact the pivotal structure, the two position portions integrated as a unique piece but to be mounted to two lateral sides of the supportive shaft portion, the two position portions sleeving respectively two opposing ends of the supportive shaft, the pivotal structure being located between the two position portions.

3. The pressure-balanced mechanism for a print head of claim 1, wherein each of the two depression structures further includes a sliding body, a rotation-interfering member, a twist knob, a spring and a contact head, the sliding body movably sleeving the fix shaft, the rotation-interfering member being rotationally mounted to the sliding body, the twist knob sleeving both the sliding body and the rotation-interfering member, the spring sleeving freely the rotation-interfering member, the contact head being connected with the spring at one end and having another end to contact an outside of the frame structure.

4. The pressure-balanced mechanism for a print head of claim 3, wherein each of the two depression structures further includes a sleeve tube screwed to engage the sliding body and allowing the contact head to protrude therefrom.

* * * * *